US011206931B2

(12) United States Patent
Longenecker et al.

(10) Patent No.: US 11,206,931 B2
(45) Date of Patent: Dec. 28, 2021

(54) CONVERTIBLE BEDSIDE BASSINET AND CHANGING TABLE

(71) Applicant: ARTSANA USA, INC., Lancaster, PA (US)

(72) Inventors: Michael L. Longenecker, Lancaster, PA (US); Matthew J. Ransil, Richland, PA (US); Michael S. Degrace, Red Lion, PA (US)

( * ) Notice: Subject to any disclaimer, the term of this patent is extended or adjusted under 35 U.S.C. 154(b) by 491 days.

(21) Appl. No.: 16/279,898

(22) Filed: Feb. 19, 2019

(65) Prior Publication Data

US 2019/0254443 A1 Aug. 22, 2019

Related U.S. Application Data

(60) Provisional application No. 62/633,415, filed on Feb. 21, 2018.

(51) Int. Cl.
*A47D 11/00* (2006.01)
*A47D 5/00* (2006.01)
(Continued)

(52) U.S. Cl.
CPC ..... *A47D 11/005* (2013.01); *A47D 5/00* (2013.01); *A47D 7/007* (2013.01); *A47D 7/01* (2013.01);
(Continued)

(58) Field of Classification Search
CPC . A47D 5/00; A47D 7/007; A47D 7/01; A47D 9/00; A47D 11/00; A47D 11/005;
(Continued)

(56) References Cited

U.S. PATENT DOCUMENTS 3,090,634 A * 5/1963 Rubin ..... B62B 7/12 280/31
3,100,899 A * 8/1963 Wright ..... A61G 7/0507 5/430
(Continued)

FOREIGN PATENT DOCUMENTS

CN 105455502 A 4/2016
GB 2509126 A 6/2014
(Continued)

*Primary Examiner* — Nicholas F Polito
(74) *Attorney, Agent, or Firm* — Patent Law Associates

(57) ABSTRACT

A convertible bassinet including a mobile support enabling selective movement about a supporting surface and a braking apparatus providing the ability to secure the mobile support in a laterally fixed position on the surface. The mobile support also includes a vertical adjustment mechanism enabling the height of the bassinet to be altered by a user. The bassinet further includes a top perimeter frame with a position actuator for varying the height of the top perimeter frame above a child supporting surface. When in an uppermost position the perimeter frame defines a bassinet. A changing table surface is defined when the perimeter frame is repositioned to a lowermost position. Resilient connectors between the position actuator and the perimeter frame members allow the top perimeter frame to move from the uppermost position to the lowermost position independent of movement of the position actuator.

20 Claims, 12 Drawing Sheets

(51) Int. Cl.
*A47D 7/00* (2006.01)
*A47D 7/01* (2006.01)
*A47D 9/00* (2006.01)
*A47D 15/00* (2006.01)

(52) U.S. Cl.
CPC ..... *A47D 9/00* (2013.01); *A47D 11/00* (2013.01); *A47D 15/008* (2013.01)

(58) Field of Classification Search
CPC .... A47D 13/00; A47D 13/063; A47D 13/068; A47D 15/008; A61G 7/0509; A61G 11/002; A61G 11/006; B62B 7/123; B62B 9/14; B62B 9/142
See application file for complete search history.

(56) References Cited

U.S. PATENT DOCUMENTS 4,509,217 A * 4/1985 Therrien ..... A61G 7/0507 5/428
5,761,755 A * 6/1998 Huang ..... A47D 13/063 16/324
6,022,310 A * 2/2000 Goldberg ..... A61G 11/00 600/22
6,704,949 B2 3/2004 Waldman et al.
6,880,188 B1 * 4/2005 Schmidt ..... A61B 6/4283 177/144
7,070,188 B2 7/2006 Waldman et al.
8,429,771 B2 4/2013 Long
9,198,524 B2 12/2015 Horst et al.
9,565,950 B2 2/2017 Horst et al.
9,648,961 B1 * 5/2017 Lovely ..... A47D 9/00
9,883,750 B2 2/2018 Yi
2003/0137130 A1 * 7/2003 Chang ..... B60B 33/0073 280/641
2005/0098969 A1 * 5/2005 Waldman ..... B60B 33/0068 280/47.38
2005/0241064 A1 11/2005 Lopes et al.
2006/0026762 A1 * 2/2006 Hornbach ..... A61G 7/0528 5/611
2007/0017025 A1 * 1/2007 Myer ..... A47D 7/002 5/99.1
2009/0121454 A1 * 5/2009 Tomasi ..... B62B 7/08 280/642
2012/0047654 A1 * 3/2012 Simmonds ..... A61G 7/0521 5/430
2012/0269568 A1 * 10/2012 Matsubara ..... A61G 11/006 403/104
2012/0274105 A1 * 11/2012 Chen ..... A47D 13/102 297/183.1
2014/0310870 A1 10/2014 Czach et al.
2016/0106226 A1 * 4/2016 Yi ..... A47D 9/00 5/11
2016/0198864 A1 7/2016 Yang
2016/0286979 A1 10/2016 Sclare
2017/0238721 A1 * 8/2017 Damiani ..... A47D 7/02
2018/0192784 A1 * 7/2018 Yang ..... A47D 9/02
2019/0099012 A1 * 4/2019 Zhang ..... A47D 13/06
2020/0046141 A1 * 2/2020 Mu ..... A47D 9/00

FOREIGN PATENT DOCUMENTS

WO WO-9739661 A1 * 10/1997 ..... A47D 15/008
WO 2008028597 A1 3/2008
WO WO-2018146707 A1 * 8/2018 ..... A47D 9/00
WO WO-2019055671 A * 3/2019 ..... A61G 11/002

* cited by examiner

CONVERTIBLE BEDSIDE BASSINET AND CHANGING TABLE

CROSS REFERENCE TO RELATED APPLICATIONS

This application claims the priority benefit of U.S. provisional patent application Ser. No. 62/633,415 filed on Feb. 21, 2018.

BACKGROUND OF THE INVENTION

This invention relates generally to the field of infant cribs, and, more particularly to an elevated bedside bassinet that is mobile so that it may be conveniently relocated about a room and easily reconfigured to provide a changing table surface.

Parents often prefer for infants to sleep in the same room with them for the first few months of life so they more easily monitor the infant. Locating a crib, a bedside bassinet, and a changing table in a bedroom usually requires far more space than is available. Child care product manufacturers have responded by offering care articles that may be reconfigured to serve multiple purposes to reduce the number of separate items in a room that may be necessary to attend to the child's needs.

Mobile products require braking mechanisms to prevent unintended movement when a child is placed thereon. These products may also include height adjusting mechanisms to allow caregivers to place the bassinet or changing table surface at a height that is most convenient. Actuators for such mechanisms should be conveniently accessible for caregivers, often locating actuator handles on portions of the assembly that move in relation to the mechanism. A mobile bedside bassinet having means to adjust the height of the bassinet as well capability to be reconfigured to provide a changing table surface would be useful and beneficial to users.

SUMMARY OF THE INVENTION

Accordingly, the present invention, in any of the embodiments described herein, may provide one or more of the following advantages:

It is an object of the present invention to provide a bassinet for a child that may be selectively moved about a room and includes a braking system enabling the bassinet to be selectively immovably positioned in a desired location in the room.

It is a further object of the present invention to provide an adjustable bassinet for a child that is laterally mobile and vertically adjustable to allow bedside positioning of the bassinet's child supporting surface.

It is a still further object of the present invention to provide a mobile bassinet having a child supporting surface that is easily reconfigurable between a bassinet for holding a sleeping child and a changing table surface.

It is a still further object of the present invention to provide a convertible bassinet and changing table for a child that is durable in construction, inexpensive of manufacture, carefree of maintenance, easily assembled, and simple and effective to use.

These and other objects are achieved in accordance with the present invention by providing a convertible bassinet that features a mobile support enabling selective movement and a braking apparatus providing the ability to secure the mobile support in a laterally fixed position. The mobile support also includes a vertical adjustment mechanism enabling the height of an infant supporting surface to be altered by a user. The bassinet further includes a moveable top perimeter frame with a position actuator for varying the height of the top perimeter frame above the infant supporting surface. When in an uppermost position the perimeter frame defines a bassinet. A changing table surface is defined when the perimeter frame is repositioned to a lowermost position. Resilient connectors between the position actuator and the perimeter frame members bias the top perimeter frame toward the uppermost position or the lowermost position based on movement of the position actuator.

BRIEF DESCRIPTION OF THE DRAWINGS

The advantages of this invention will be apparent upon consideration of the following detailed disclosure of the invention, especially when taken in conjunction with the accompanying drawings wherein.

DESCRIPTION OF THE PREFERRED EMBODIMENT(S)

Figure 1:
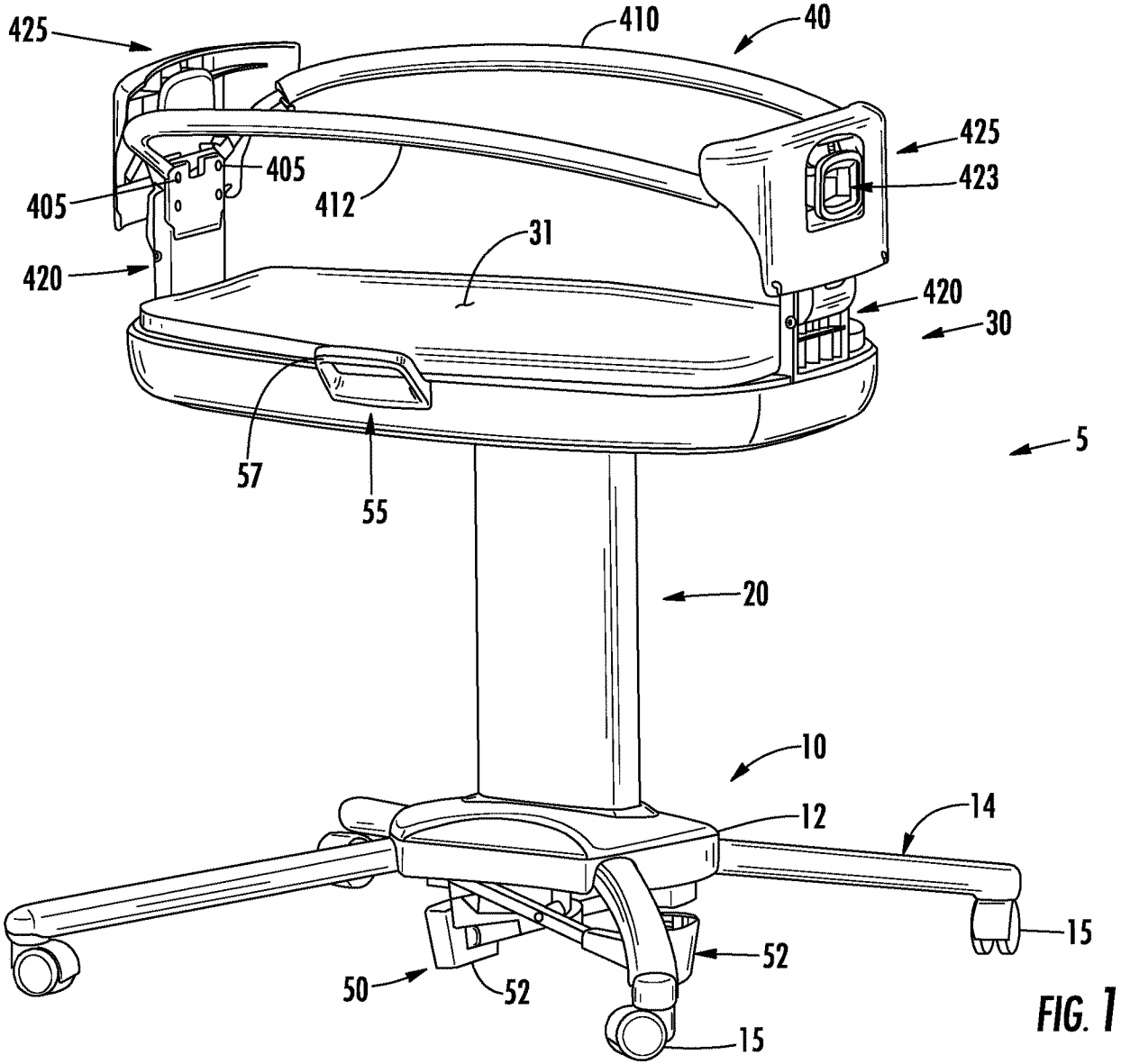
FIG. 1 is a perspective view of a mobile bassinet embodying aspects of the present invention and shown with a child supporting platform configured as a bassinet.

Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail. Also, any reference herein to the terms "up" or "down," or "top" or "bottom" are used as a matter of mere convenience and are determined as the item would normally be positioned on a level surface. Furthermore, the various components shown or described herein for any specific application of this invention can be varied or altered as anticipated by this invention and the practice of a specific application of any element may already be widely known or used in the art by persons skilled in the art and each will likewise not therefore be discussed in significant detail. When referring to the figures, like parts are numbered the same in all of the figures.

Referring to the figures, an exemplary bassinet 5 incorporating principles of the present invention is shown comprising a base structure 10 including a base hub 12 with a plurality of support legs 14 extending generally radially therefrom. Wheels 15 connected by swivel connectors on distal ends of the legs 14 provide mobility for the base structure 10 on a floor or similar supporting surface. An upstanding support column 20 extends upwardly from the base structure 10. The support column 20 may comprise one or more discrete column elements or may comprise a single column portion, as illustrated. A child-supporting platform 30 is attached adjacent to the upper end 29 of the support column 20 opposite from the base structure 10 and configured to provide a generally horizontal planar surface 31 upon which an infant child may be positioned.

A braking mechanism 50 is provided in the base structure 10 to allow the bassinet 5 to be rendered immobile on the supporting surface as a user may so choose. The braking mechanism 50 may comprise one or more feet 52 that are moveable between a disengaged position in which the feet 52 are elevated or retracted to a position of non-contact with the supporting surface (floor) upon which the bassinet 5 is positioned, and an engaged position in which the feet 52 are lowered or extended into contact with the floor. The contact force between the feet 52 and the floor creates enough friction for the braking mechanism 50 to render the bassinet immobile while the braking mechanism 50 is engaged.

The braking mechanism 50 may be activated by a moveable braking handle 55 disposed on the child-supporting platform 30. The braking handle 55 is configured so that a grab portion 57 of the handle is conveniently positioned so that it may be grasped by a user when the braking handle 55 is moved to disengage the braking mechanism 50. When the braking handle 55 is moved to engage the braking mechanism, the grab portion 57 is preferably positioned so that it does protrude beyond the periphery of the child supporting platform 30 where it might impede movement around the bassinet 5 by a user. Movement of the braking handle 55 to the disengaged position extends the grab portion 57 outside of the periphery of the child supporting platform where is also serves as a convenient hand hold for a user to guide the bassinet to a desired location. Movement of the braking mechanism 50 to the engaged position locates the grab portion 57 partially beneath and within the periphery of the child supporting platform 30 where it is less likely to be accidentally disengaged.

The support column 20 is includes telescoping section 23 which enable the height of the child support structure 30 to be selectively varied. The support column 20 further includes a height fixing apparatus 25 that retains the telescoping section 23 in a desired height configuration in relation to a fixed section 21 of the support column 20 and allows selective release so that the height of the child support structure 30 may be altered. The height fixing apparatus 25 may include a mast 252 attached to and upwardly extending from the base 10 having a plurality of fixing holes 254 engageable by one of more moveable fixing pins 256. Mast 252 may be integral to the fixed section 21 and of the support column 20, or it may be a separate structure. The fixing pins 256 and a fixing pin mechanism 255 for moving them is preferably anchored to the telescoping section 23 and child supporting platform 30 for movement therewith. The height fixing apparatus 25 may include an actuation handle 259 to enable selective release from a location proximate to the braking handle 55 or other more accessible location on the bassinet 5. One or more rotatable shafts 257 and a linkage 258 may be provided to operably connect the remote actuation apparatus 259 to the fixing pin mechanism 255

The support column 20 preferably houses a drive mechanism 60 operably connecting the moveable handle 55 to the braking mechanism 50 and accommodate the change in height of the support column. The drive mechanism 60 may include a rotating shaft 62 that transfers motion of the grab portion 57 to the braking mechanism 50. The connections between the rotating shaft 62 and the braking mechanism 50 or the handle 55 may include gears, cams, of linkages 64, or the like for converting the desired motions between the handle 55 and the braking feet 52. The rotating shaft 62 includes torque transmitting sections 621, 622 that telescopically move in response to vertical movement of the support column 20 and allow the braking mechanism to be operated from any of the selected heights of the child support structure 30. The torque transmitting sections 621, 622 may include splines, square drive, asymmetric shapes, or other known configurations of shaft couplings enabling axial displacement.

A cam 625 or the link may be provided on the lower end of the rotating shaft to drive vertical movement of the braking feet 52. In the illustrated embodiment, cam 625 engages followers 627 connected to mounting arms 522 on which the braking feet 52 are attached. In one embodiment, the mounting arms 522 are moveably connected at a proximal end to the base 10; the braking feet 52 are connected to the distal ends. The cam 625 and followers 627 are disposed at a location between the ends and enable vertical displacement of the braking feet 52 responsive to rotational movement of the cam 625.

The telescoping section 23 also enables the column support 20 to be separated so that the bassinet 5 may be reconfigured into a smaller package, such as for shipping between manufacture and the consumer. The fixed column section 21 and telescoping column section 23 are designed for easy assembly by an end user and configured to assure proper alignment during assembly. Similarly, the rotating shaft 62 and drive mechanism 60 is automatically aligned for proper operation as part of the column support assembly process without special end-user involvement to align the various components.

The child supporting structure 30 may include a moveable perimeter frame 40 attached to the child supporting structure 30 and moveable by adjustable elevators 42. The perimeter frame 40 is preferably positioned in a plane generally parallel to and above the planar surface 31 to define an upper periphery of the child supporting structure 30. The perimeter frames 40 stabilizes soft goods attached to the child supporting structure 30. Anchor structures 420 extending upwardly from the planar surface 31 provide elevated attachment locations for the perimeter frame. It is preferable for the anchor structures to be opposingly located about the periphery of the planar surface 31, such as at opposite ends. Soft goods attached to the perimeter frame 40 and the child supporting structure 30 span the space between the planar surface and the perimeter frame to establish an upstanding barrier surrounding the planar surface 31 to contain an infant.

Figure 2:
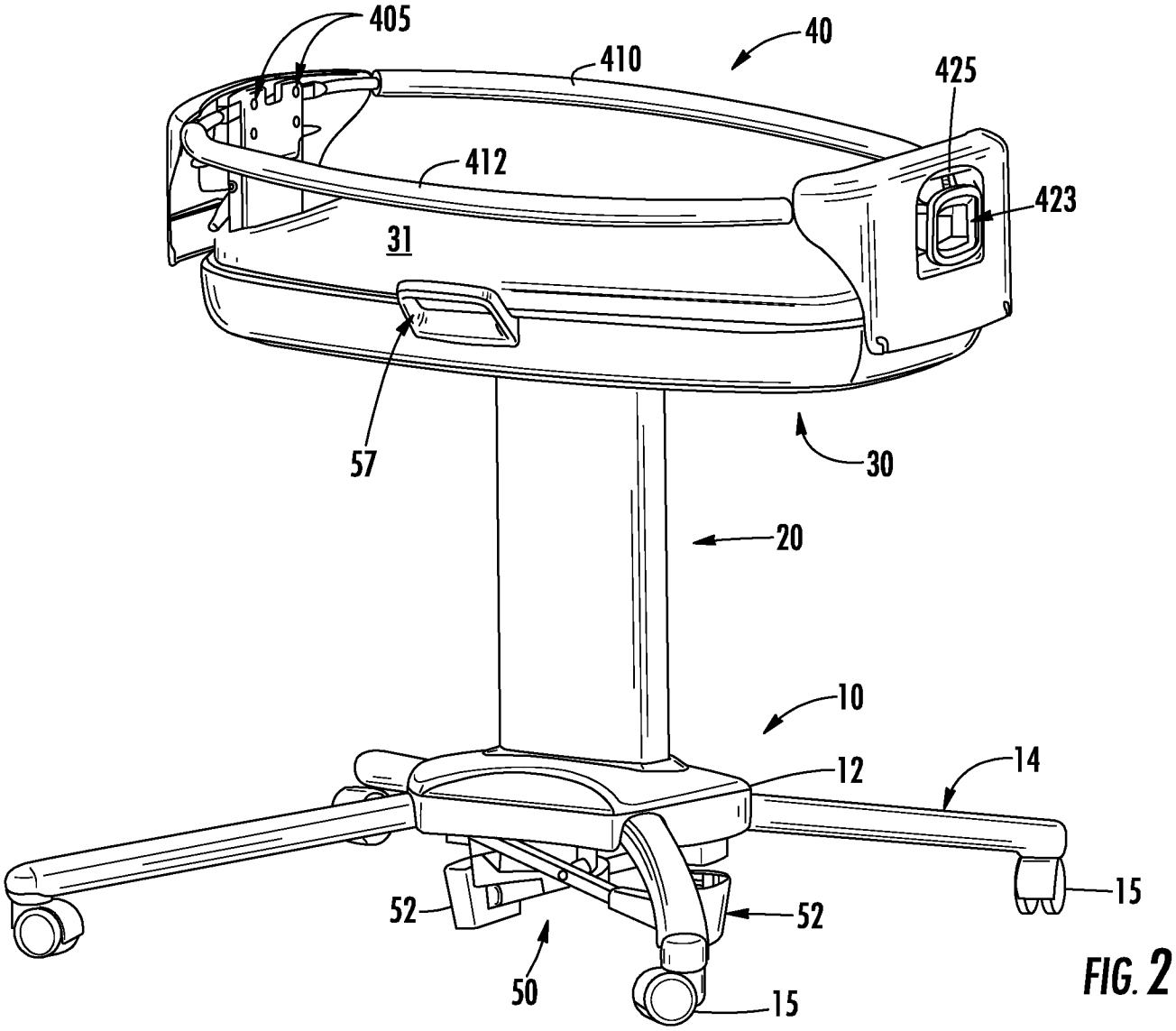
FIG. 2 is a perspective view of the mobile bassinet of FIG. 1 shown with the child supporting platform configured as a changing table surface.
Figure 3:
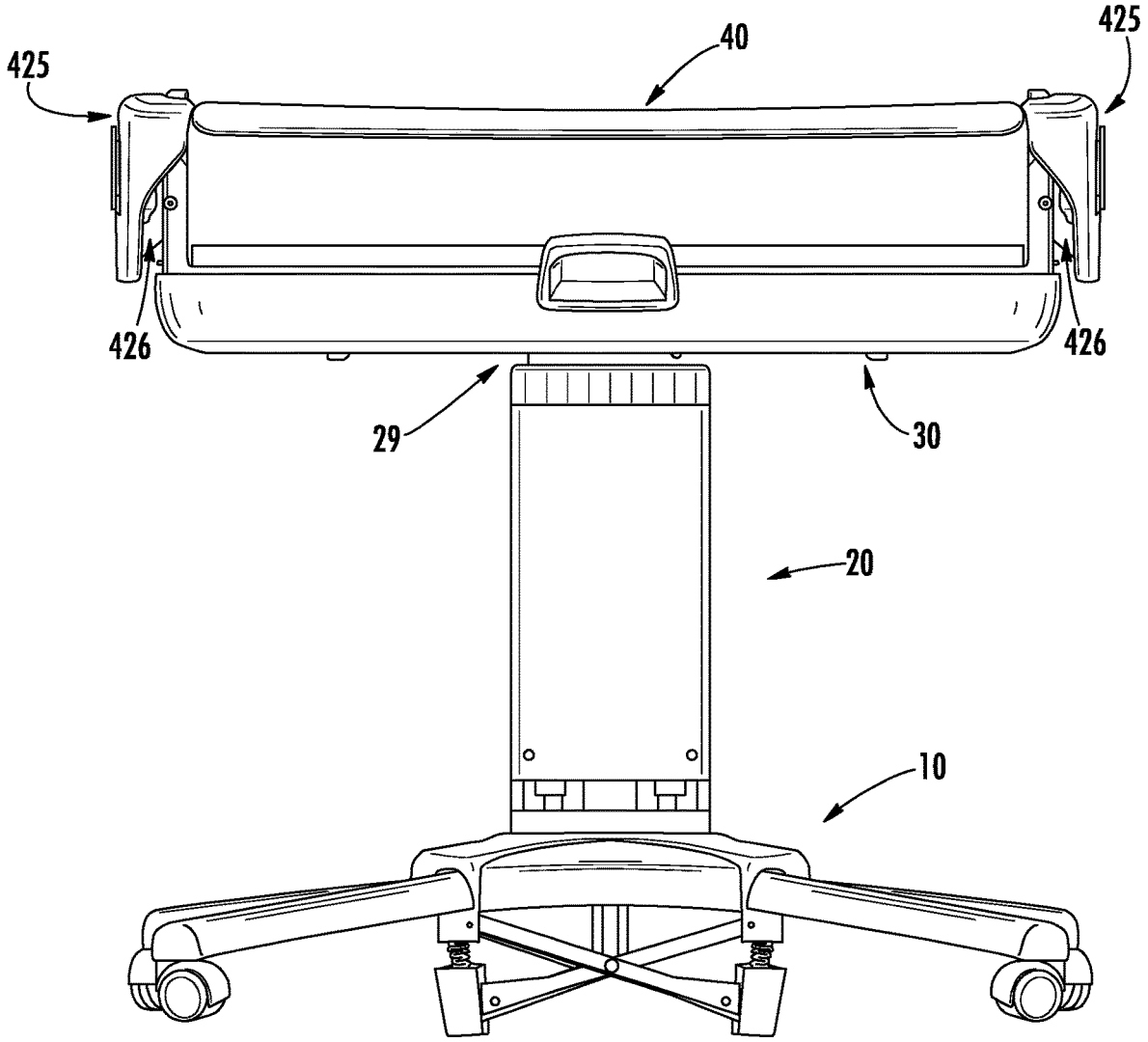
FIG. 3 is an elevation view of the mobile bassinet of FIG. 2 shown having the child supporting surface in a lowered position.
Figure 4:
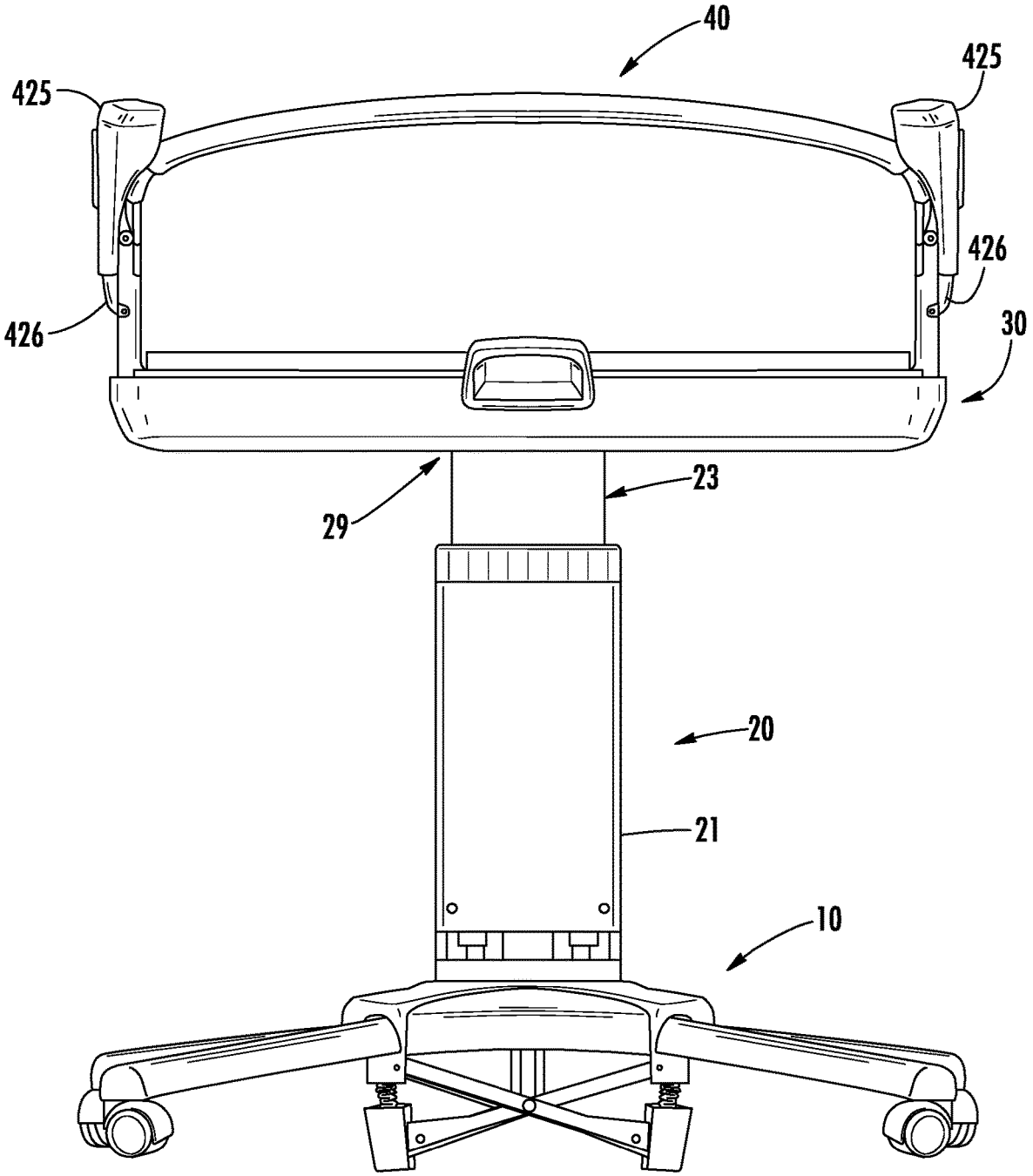
FIG. 4 is an elevation view of the mobile bassinet of FIG. 1 shown having the child supporting surface in a raised position.
Figure 5:
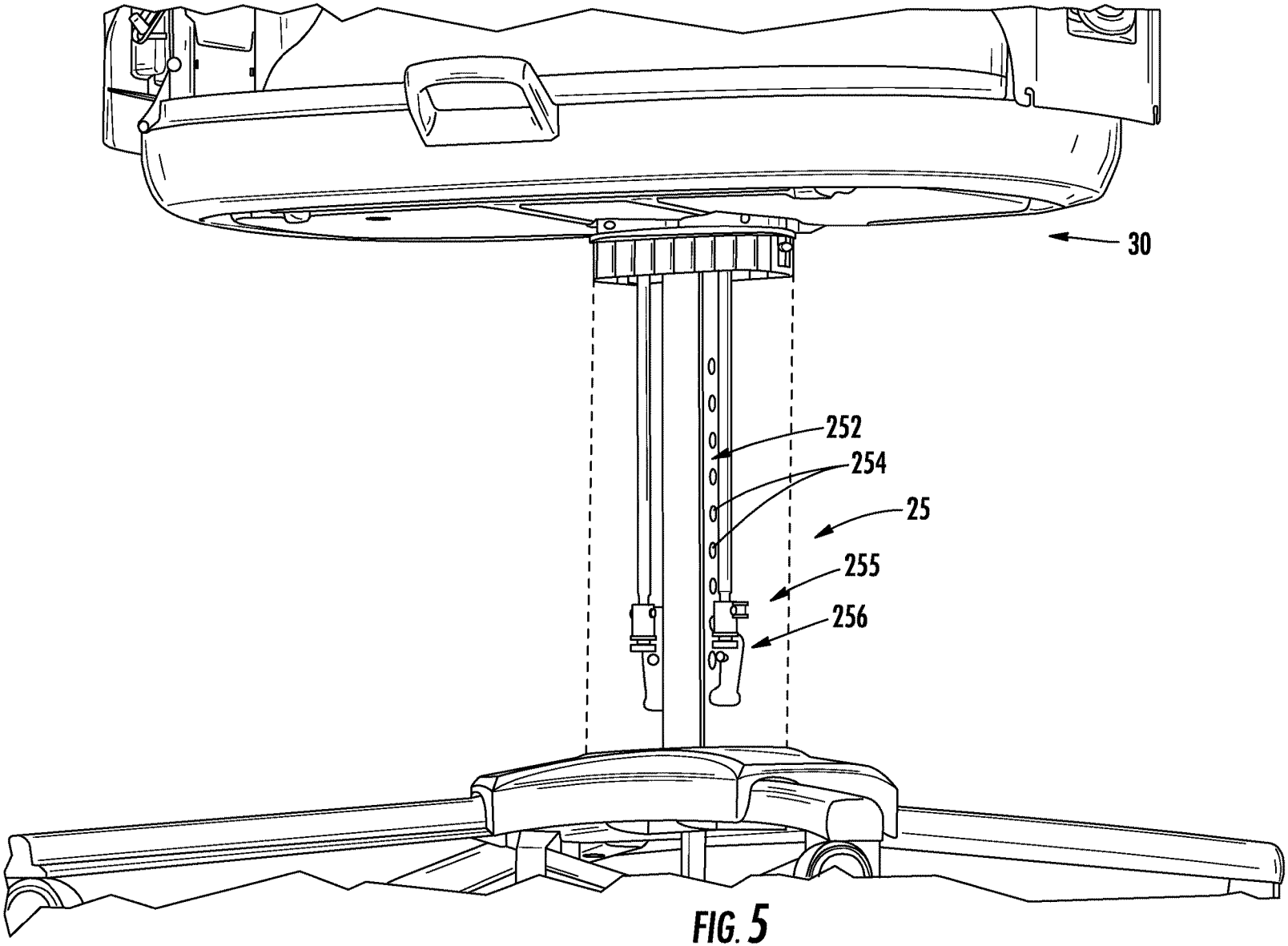
FIGS. 5-8 provide a partial view of the lower side of the mobile bassinet of FIG. 1 illustrating height adjustment and parking brake means.
Figure 6:
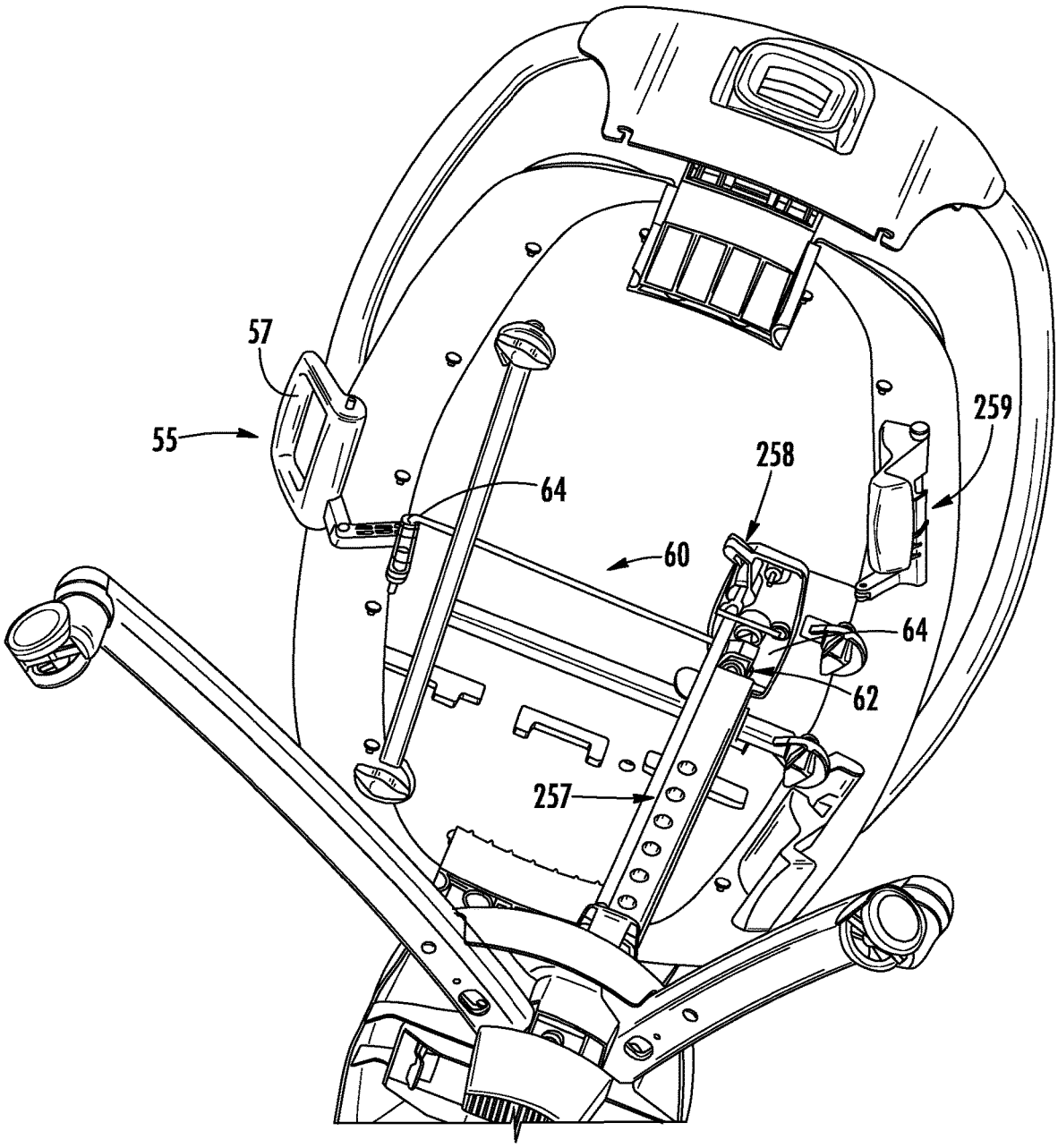
Figure 7:
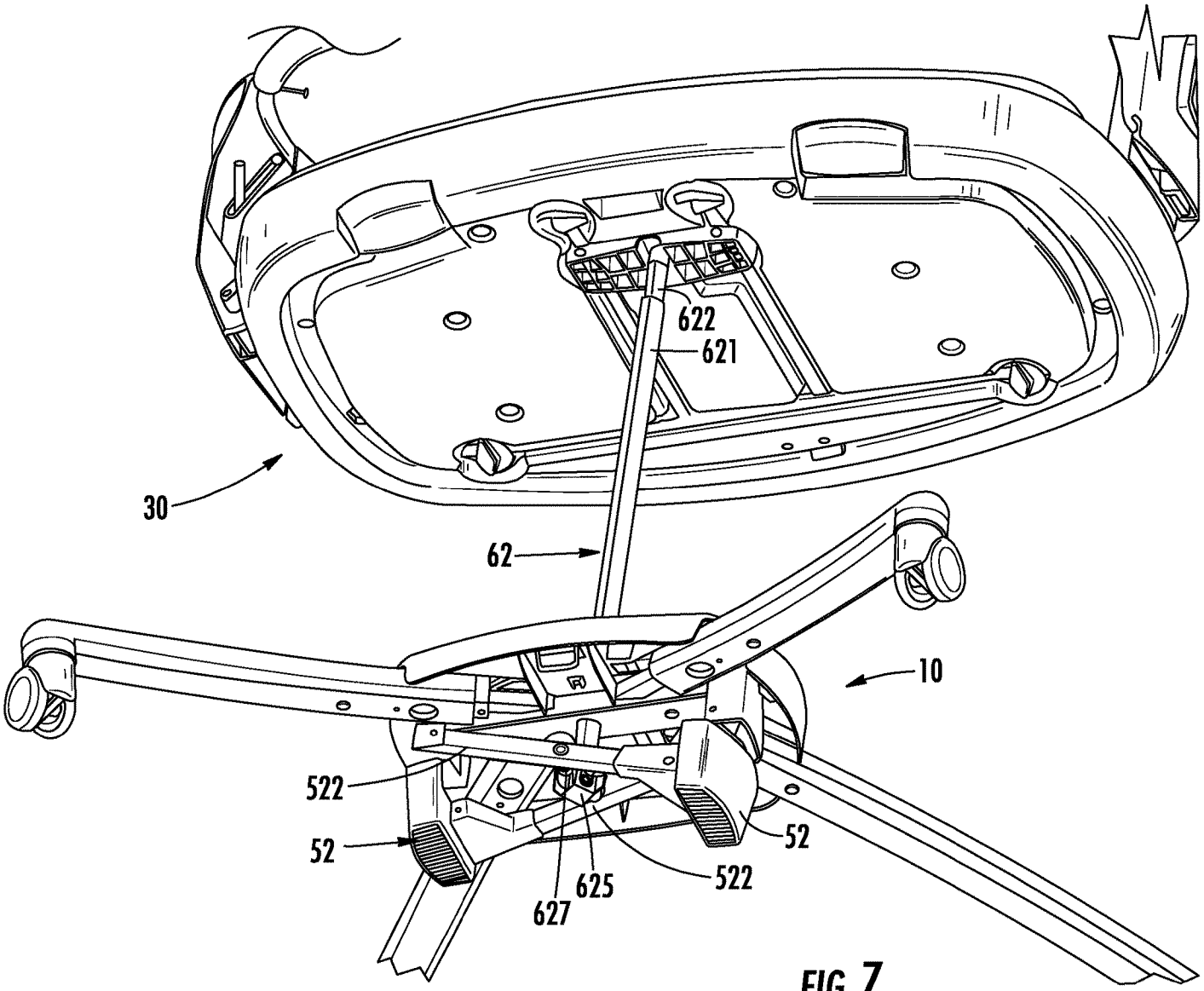
Figure 8:
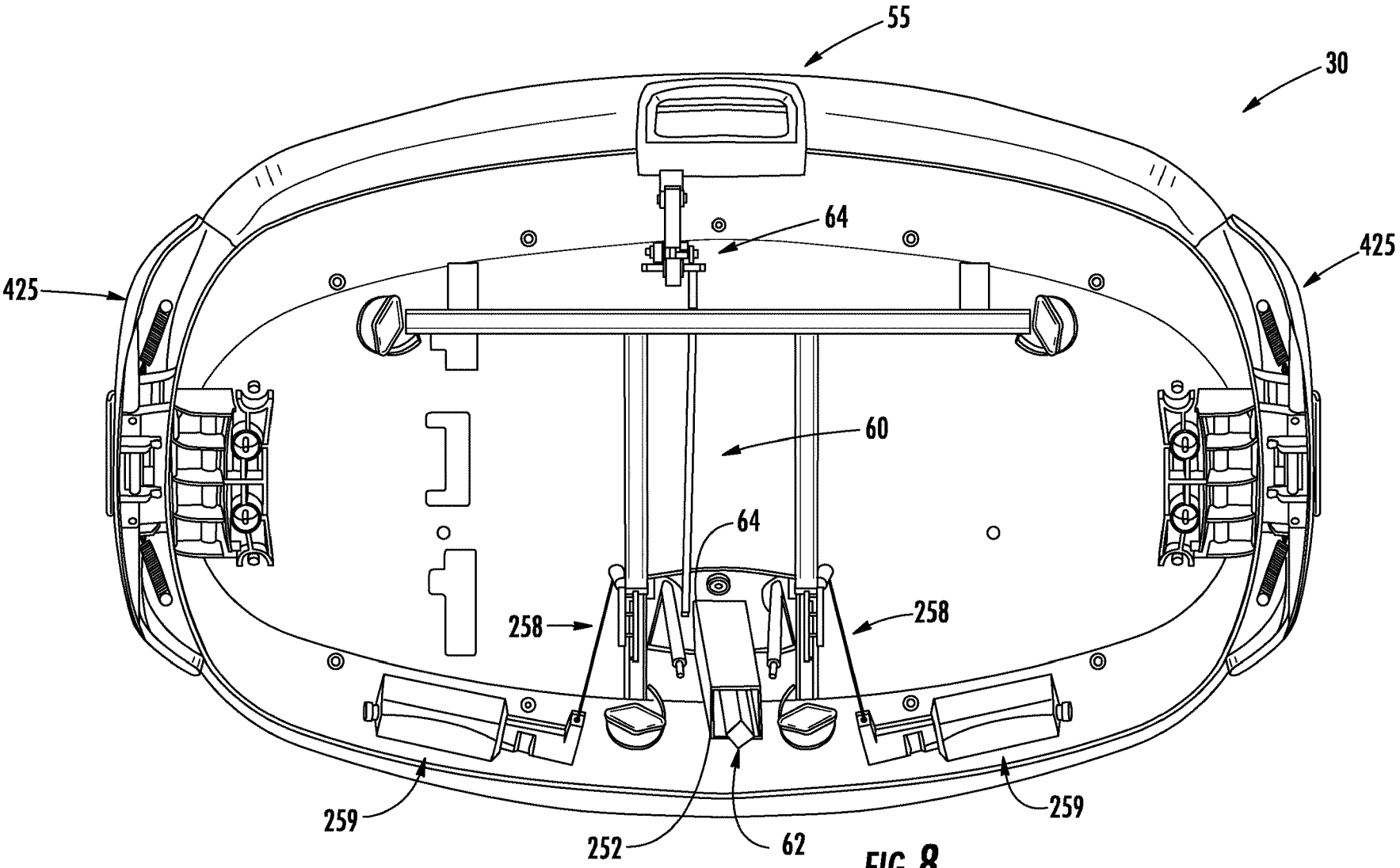

The perimeter frame 40 may include a first frame portion 410 and a second frame portion 412 wherein each frame portion is moveably connected at each end to the anchor structures 420. The first and second frame portions 410, 412 are preferably symmetrically arranged in a manner such that each defines approximately half of the perimeter frame 40. The connection between the first and second portions and the anchor structures may include pivoting connectors 405 at each end of the first and second portions to allow pivoting movement of the portions about a fixed pivot location on the anchor structures, movement being between raised and lowered positions. Movement of the first and second portions 410, 412 allows the child supporting structure 30 to be configured for a napper (raised position, FIG. 1) and a changing table (lowered position, FIG. 2).

The anchor structures 420 may also include handle actuators 425 which are moveable between respective raised and lowered positions. In one embodiment, each handle actuator 425 is moveably connected to a respective anchor structure 420 by a parallelogram linkage 426 that maintains the general upstanding orientation of the handle actuator as it moves between raised and lowered positions for ease of user operation. Each handle actuator 425 also includes a releasable latching mechanism 423 that prevents unintentional movement of the handle actuator absent user actuation.

Figure 9:
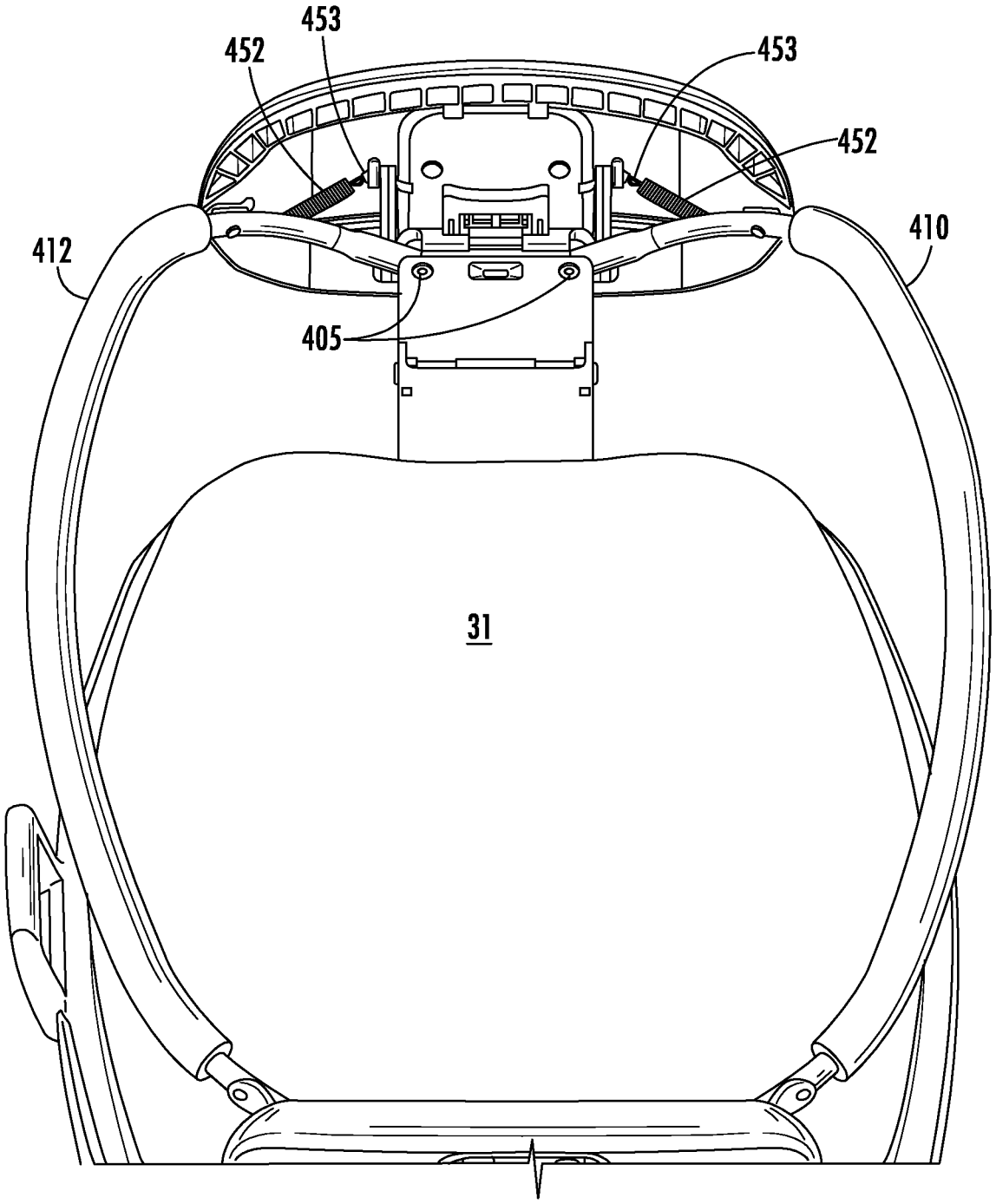
FIGS. 9 through 12 provide detail views of a portion of the apparatus for converting the child support surface between bassinet and changing table configurations.
Figure 10:
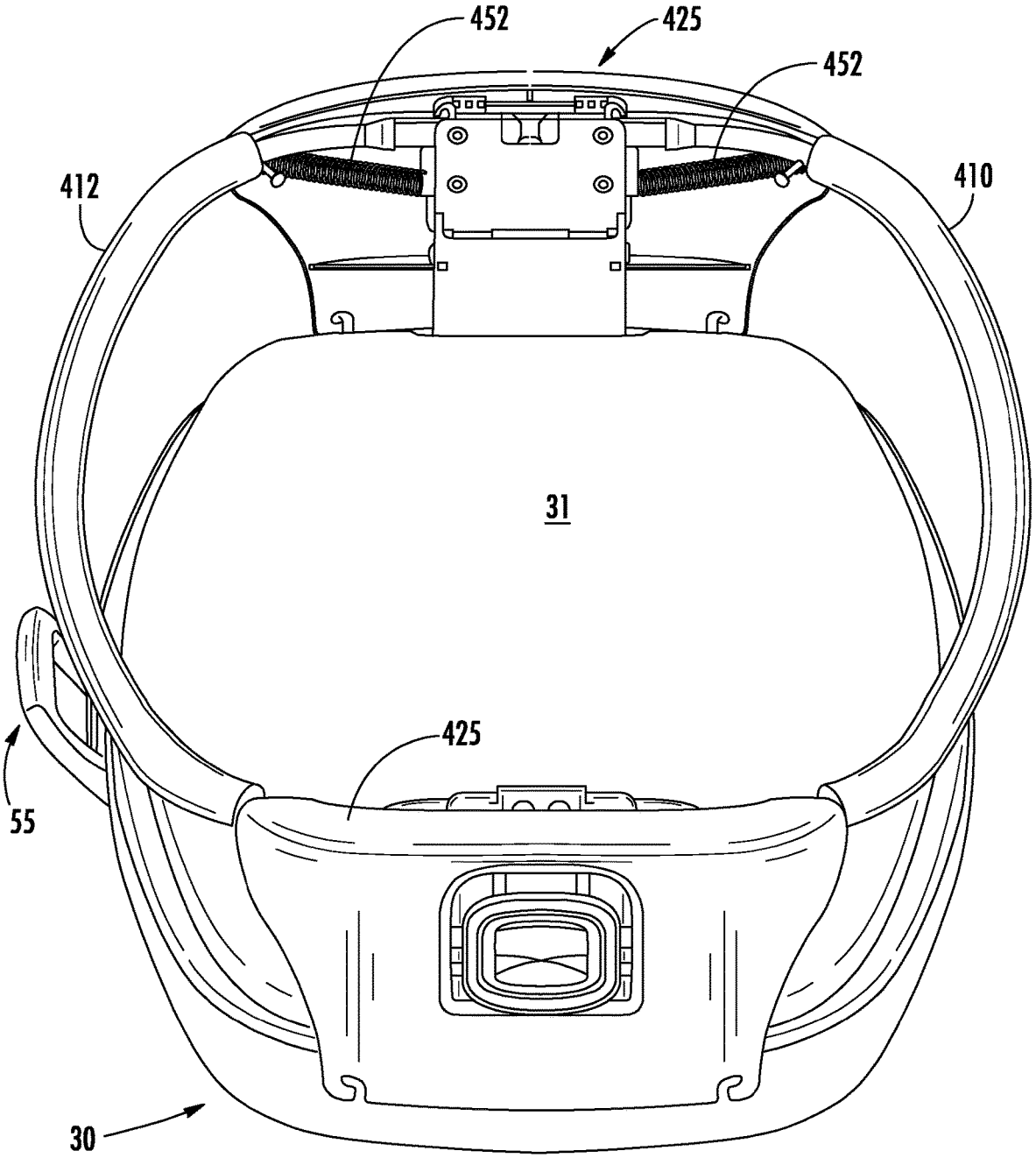
Figure 11:
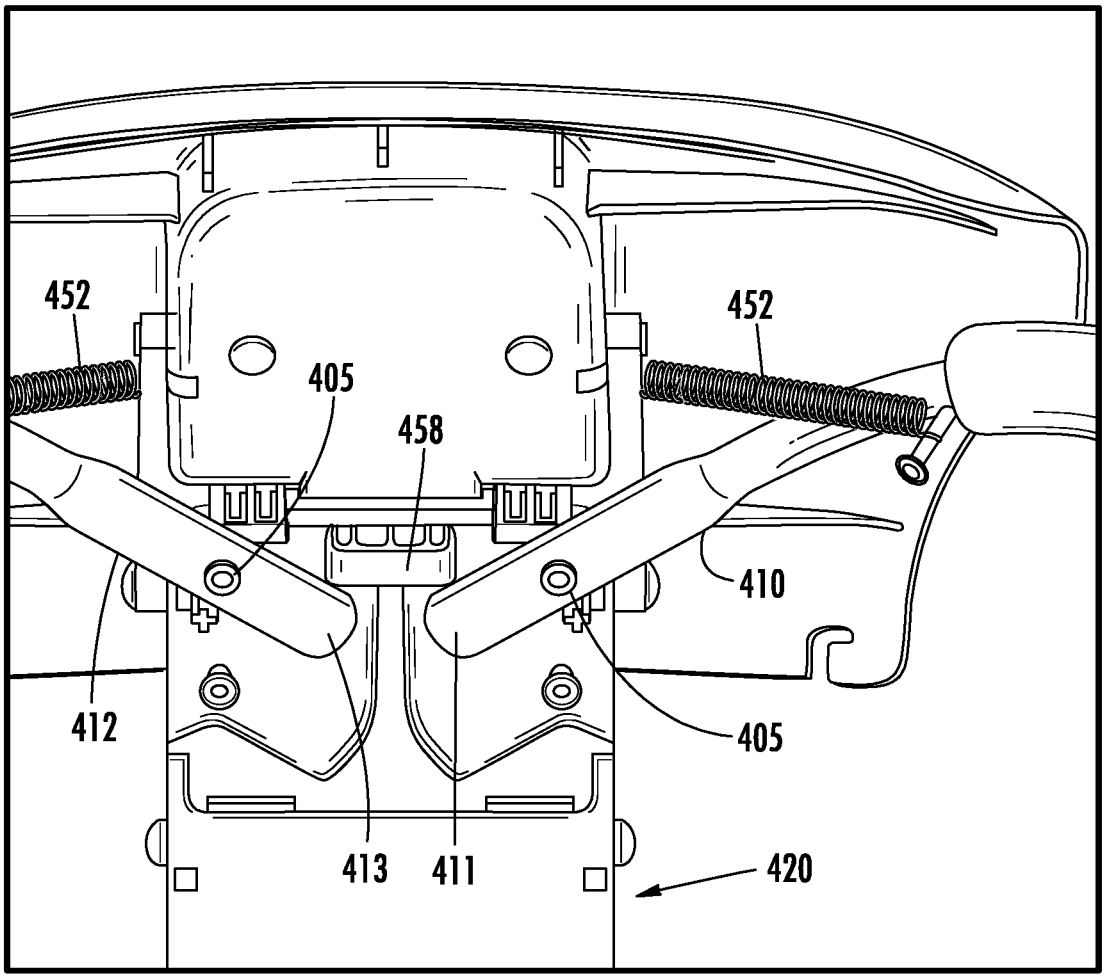
Figure 12:
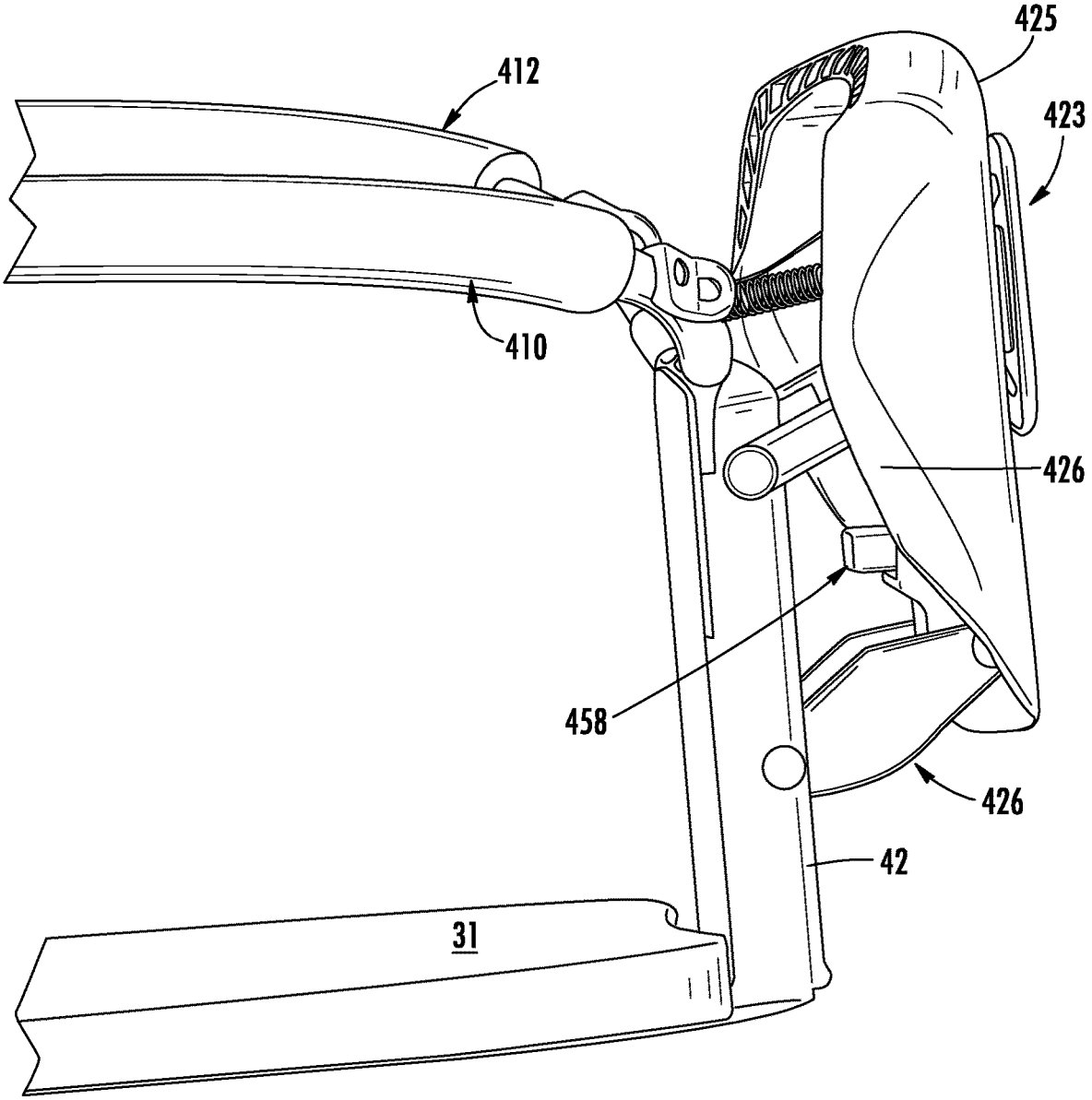

Resilient elements 452 interconnect the handle actuators 425 and the first and second frame portions 410, 412. A first end of the resilient elements 453 is connected to the actuators 425 while a second end of each resilient element is connected to a respective first or second frame portion 410, 412. Repositioning the actuators 425 displaces the first ends 453 of the resilient elements to a position above or below, respectively, the pivot connectors 405 applying the biasing force to the first and second frame portions 410, 412 and causing the frame portions to be raised or lowered, respectively. When the actuators are moved to the raised position (FIG. 9), the first ends 453 positioned above the pivot connectors 405 resulting in an upward application of the biasing force on the frame portions, moving them into the raised position. When the actuators 425 are moved to the lowered position (FIG. 10), the first ends 453 are positioned below the pivot connections 405 resulting in a downward application of the biasing force on the first and second frame portions, moving them into the lowered position.

The handle actuators include a blocking tab 458 configured to engage frame ends 411, 413 to prevent the first and second frame portions 410, 412 from being downwardly deflected from the raised position while the handle actuator 425 is in the raised position. A similar blocking structure may be provided on the handle actuator 425 to prevent upward movement of the frame portions 410, 412 from the lowered position.

The handle actuators 425 include a latching mechanism 423 to retain them in at least the raised position. The latching mechanism 423 may be configured to retain the handle actuators 425 in the lowered position as well, require a user to release the latching mechanism before the handle actuators can be moved from either of the extreme positions.

Naturally, the invention is not limited to the foregoing embodiments, but it can also be modified in many ways without departing from the basic concepts. Changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A mobile infant-supporting apparatus comprising:

a generally planar child-supporting platform supported above a floor surface by a mobile base;

a perimeter frame connected to and disposed generally above the child-supporting platform, the perimeter frame having first and second elongate perimeter frame portions;

an anchor structure connecting the first and second perimeter frame portions to the child-supporting platform, each perimeter frame portion being pivotally coupled to the anchor structure to permit movement between generally opposing raised and lowered positions;

an actuator handle moveably connected to the anchor structure and operable between raised and lowered positions; and a first resilient member connected between the first perimeter frame portion and the actuator handle and a second resilient member connected between the second perimeter frame portion and the actuator handle, the resilient members biasing respective perimeter frame portions toward the raised position when the actuator handle is in the raised position and toward the lowered position when the actuator handle is moved to the lowered position.

2. The mobile infant-supporting apparatus of claim 1, wherein the connection of the resilient members to the actuator handle is positioned above the pivot connections of the perimeter frame portions when the actuator handle is in the raised position and below the pivot connections of the perimeter frame portions when the actuator handle is in the lowered position.

3. The mobile infant-supporting apparatus of claim 2, wherein the actuator handle includes a blocking member configured to prevent movement of the perimeter frame portions from the raised position while the actuator handle is in the raised position.

4. The mobile infant-supporting apparatus of claim 3, wherein the actuator handle includes a latch configured to releasably retain the actuator handle in at least the raised position.

5. The mobile infant-supporting apparatus of claim 4, wherein the actuator handle connection to the anchor structure includes a linkage configured to maintain the actuator handle in a generally upstanding orientation as it is moved between raised and lowered positions.

6. The mobile infant-supporting apparatus of claim 1, wherein the perimeter frame defines a plane that is generally parallel to and spaced above the plane of the child-supporting platform.

7. The mobile infant-supporting apparatus of claim 6, wherein the first and second perimeter frame portion pivotal connections are generally horizontally aligned.

8. The mobile infant-supporting apparatus of claim 1, wherein the base further comprises an upstanding support includes telescopically engaged upper and lower upstanding support portions, telescoping movement thereof enabling the spacing between the base portion and the child supporting platform to be selectively adjusted.

9. The mobile infant-supporting apparatus of claim 8, wherein the upstanding support further includes a height fixing mechanism configured to releasably fix the upper and lower upstanding support portions in one of a plurality of telescoped positions, the height fixing mechanism having an actuation handle operably connected by a rotating shaft to a fixing device.

10. The mobile infant-supporting apparatus of claim 9, wherein the fixing device comprises a moveable lug disposed on the upper upstanding portion engaging one of a plurality of receptacles disposed on the lower support portion.

11. The mobile infant-supporting apparatus of claim 1, wherein the base further comprises a braking mechanism having a moveable foot operable by a braking actuator disposed on the child-supporting platform.

12. The mobile infant-supporting apparatus of claim 11, wherein the braking mechanism includes an actuator shaft disposed within the upstanding support and operably connecting the moveable foot and the braking actuator by rotation thereof, the actuator shaft having a telescoping portion enabling rotational operation of the actuator shaft in any of the plurality of telescoped positions.

13. A mobile infant-supporting apparatus comprising:

a wheel-supported base portion;

an upstanding support portion connected to the base portion;

a generally planar child supporting platform connected to a distal end of the upstanding support portion opposite from the base portion;

a perimeter frame generally disposed above the child supporting platform, the perimeter frame having a first portion and a second portion, each being pivotally connected at respective ends along a generally horizontal axis to the child supporting platform and independently moveable between generally opposing raised and lowered positions;

a perimeter frame actuator attached to the child supporting platform and moveable between generally opposing first and second positions; and first and second resilient members connecting the perimeter frame actuator to respective first and second perimeter frame portions, the resilient members urging respective perimeter frame portions toward the lowered position when the perimeter frame actuator is moved to the first position, the resilient members urging respective perimeter frame portions toward the raised position when the perimeter frame actuator is moved to the second position.

14. The mobile infant-supporting apparatus of claim 13, wherein the upstanding support includes telescopically engaged upper and lower upstanding support portions, telescoping movement thereof enabling the spacing between the base portion and the child supporting platform to be selectively adjusted.

15. The mobile infant-supporting apparatus of claim 14, wherein the upstanding support further includes a height fixing mechanism configured to releasably fix the upper and lower upstanding support portions in one of a plurality of telescoped positions, the height fixing mechanism comprising an actuation handle operably connected by a rotating shaft to a fixing device.

16. The mobile infant-supporting apparatus of claim 15, wherein the fixing device comprises a moveable lug disposed on the upper upstanding portion engaging one of a plurality of receptacles disposed on the lower support portion.

17. The mobile infant-supporting apparatus of claim 13, wherein the perimeter frame actuator includes a blocking member configured to engage the perimeter frame portions when the perimeter frame actuator is in the second position and the perimeter frame portions in the raised position and thereby prevent movement of the perimeter frame portions from the raised position.

18. The mobile infant-supporting apparatus of claim 17, wherein the perimeter frame actuator includes a latch configured to releasably retain the perimeter frame actuator in at least the second position.

19. The mobile infant-supporting apparatus of claim 13, wherein the perimeter frame actuator connection to the child supporting platform includes a linkage configured to maintain the perimeter frame actuator in a generally upstanding orientation as it is moved between first and second positions.

20. The mobile infant-supporting apparatus of claim 13, wherein the connection of the resilient members to the perimeter frame actuator is positioned above the pivot connections of the perimeter frame portions when the perimeter frame actuator is in the second position and below the pivot connections of the perimeter frame portions when the perimeter frame actuator is in the first position.

* * * * *